US005692350A

United States Patent [19]

Murphy, Jr.

[11] Patent Number: 5,692,350

[45] Date of Patent: Dec. 2, 1997

[54] APPARATUS AND METHOD FOR LEVELING CLOSURES

[76] Inventor: Joseph James Murphy, Jr., 1204 Eiler Rd., Belleville, Ill. 62223-3237

[21] Appl. No.: 595,728

[22] Filed: Feb. 2, 1996

Related U.S. Application Data

[63] Continuation-in-part of Ser. No. 365,875, Dec. 29, 1994, abandoned.

[51] Int. Cl.[6] ..... E06B 1/60

[52] U.S. Cl. ..... 52/213; 49/505; 52/127.12; 52/210; 52/217; 411/533

[58] Field of Search ..... 52/127.1, 127.7, 52/127.12, 204.56, 217, 403.1, 210, 213; 49/505; 411/134, 136, 533

[56] References Cited

U.S. PATENT DOCUMENTS

| | | | |
|---|---|---|---|
| 258,839 | 5/1882 | Willson | 52/217 |
| 1,083,471 | 1/1914 | Walton et al. | 411/136 |
| 1,094,825 | 4/1914 | Warren | 411/533 |
| 2,223,338 | 12/1940 | Curren . | |
| 2,481,721 | 9/1949 | Carper | 52/217 X |
| 3,007,559 | 11/1961 | Goldberg | 49/505 |
| 3,501,866 | 3/1970 | Johnson | 52/217 X |
| 3,571,996 | 3/1971 | Braswell . | |
| 4,698,944 | 10/1987 | Wilkins, Jr. | 52/217 X |
| 4,841,696 | 6/1989 | Miller | 52/217 X |
| 5,038,538 | 8/1991 | Rozon | 52/217 X |
| 5,437,130 | 8/1995 | Raynak | 52/217 X |

FOREIGN PATENT DOCUMENTS

| | | | |
|---|---|---|---|
| 2355152 | 1/1978 | France . | |
| 1927029 | 12/1970 | Germany | 52/217 |

*Primary Examiner*—Carl D. Friedman
*Assistant Examiner*—Kevin D. Wilkens
*Attorney, Agent, or Firm*—King and Schickli

[57] ABSTRACT

A unique and simple apparatus and method allow one to simultaneously level a closure, such as a door or window, in an opening in a wall while also anchoring that closure to the wall. The apparatus includes a spring shim and an anchor. The spring shim has a pressure foot at each of two ends for engaging either the wall or the closure and an intermediate portion having a central aperture for receiving the anchor. The closure is leveled and plumbed in the opening by attaching a series of spring shims at spaced locations around the closure. The closure and attached spring shims are then positioned in the opening followed by the engaging and penetrating of the anchors into the wall.

3 Claims, 2 Drawing Sheets

APPARATUS AND METHOD FOR LEVELING CLOSURES

This is a continuation-in-part of U.S. patent application Ser. No. 08/365,875, filed on Dec. 29, 1994, entitled "Apparatus and Method for Leveling Closures" now abandoned.

TECHNICAL FIELD

The present invention relates generally to the construction field and, more particularly, to an apparatus and method for installing, leveling and plumbing a closure in a structural opening via a mechanism that simultaneously installs/anchors the closure and provides for initial and perpetual leveling and plumbing of the closure at any time.

BACKGROUND OF THE INVENTION

One of the more tedious and time consuming jobs in the construction and restoration fields is the setting (i.e. installing, leveling, and plumbing) of closures such as doors, windows, side lights, transoms, gable air vents, portals, skylights, etc., in rough structural openings.

A main problem is that closures come in all shapes and sizes ranging form typical interior doors to massive front entrances; from a typical double-hang window to large picture windows; from a rectangular shape to a triangular shape; from a circular shape to an octagon shape; from a square to an oval, and on ad infinitum.

Historically and typically even today, the closure installer (usually a carpenter) utilizes the same method and apparatus as has been used for hundreds of years for installing closures. That device is the wooden shim. The wooden shim's length, width and breadth is virtually unlimited and its availability is as close as a piece of scrap wood. From being split off a tree by an ax, carved and shaped by a pocket knife, to modern day pre-processed wood shims, the wood shim has never been equalled. It is very inexpensive to produce and it has an indefinite shelf/usage life span.

Typically, the carpenter (installer) utilizes wooden shims placed and sometime driven in the gap between the closure frame (or jamb) and the wall studs that form the rough opening. A level is used during this process to confirm the positioning of the jamb in the opening and re-adjustment of the shims is made as necessary to complete the installing, leveling and plumbing process. Levels are used on closures that have a flat vertical or horizontal side or sides. A plumb line is used on closures where a level is ineffective, such as a circular or oval closure.

Although the wooden shim is still the dominant means today for installing closures, it does have some limitations including: (1) the method of installing with wood shims is very time consuming; (2) wood shims are difficult to use on rounded surfaces (i.e. circular, oval-portals, stained glass ovals, etc.); (3) wood shims are strictly spacers and are not a means for positively anchoring a closure in an opening; and (4) wood shims do not allow one to adjust the level and plumb of a closure following installation as they are sealed behind the finished walls.

Although the wood shim does what it is designed to do and does it well, the limits characteristic of its design (a few of which have been listed above) have led to the development of the present invention. Of primary concern is the fact that virtually all building structures "settle" over time. Shrinkage, expansion, warpage and settling of building structures and the materials of which they are build occur due to natural conditions such as humidity, temperature extremes, sun, wind, earth movements and even wind, to list a few causes. This is quite evident in our older homes and our historical buildings. Although these natural occurrence can never be eliminated completely, the present invention does work and was designed to compensate for these changes. In particular, the present invention allows one to readily maintain closures as level and plumb as the day they were installed. It is not truly possible to achieve this desirable result with wooden shims.

SUMMARY OF THE INVENTION

Accordingly, it is a primary object of the present invention to provide both an apparatus and method for leveling and plumbing a closure, such as a window or door, in a structural opening at the initial installation time and to provide a very simple and easy means to allow for perpetual adjustment of the closure for purposes of maintaining level and plumb.

Yet another object of the present invention is to provide an apparatus of relatively simple and inexpensive construction that may be effectively utilized during installation of a closure in a wall opening to securely install and to reliably level and/or plumb that closure in a quick and convenient manner. Such an apparatus and its related method functions to significantly reduce labor time and accordingly labor cost in both new and renovation construction.

Yet another object of the present invention is to provide an apparatus and method of setting a closure in a wall opening that includes anchors that engage both the closure and the studs of the wall outlining the opening so as to provide a rigid and secured connection therebetween while also including spring shims that allow accurate and precise leveling and plumbing of the closure within the opening.

Still another object of the present invention is to provide an apparatus and method for installing, leveling and plumbing a closure in a wall opening allowing readjustment of level and plumb as necessary at any time subsequent to installation by means of the simple turning of a series of threaded anchors or screws. Accordingly, any settling of the construction and/or expansion or contraction of the structural components of the closure and/or studs defining the wall opening that may occur over time may be compensated for so as to insure proper operation of the closure. Such an adjustment may be made in a minimum amount of time with a minimum amount of effort for utmost convenience.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved apparatus and method are provided for installing, leveling and plumbing a closure, such as a window or door and its associated frame, in an opening of a wall. The apparatus includes an elongated spring shim formed from a sheet of resilient material. The spring shim includes a pressure foot at each of two ends for engaging either the studs of the wall defining the opening or the frame of the window or door closure. Additionally, the spring shim includes an intermediate portion between the pressure feet. This intermediate portion further includes bowed ends and a flat middle section having a central mounting aperture for receiving an anchor.

As will become more apparent as the description hereof proceeds, the anchor freely extends through the central aperture but holds the spring shim in position. Further, the anchor is of sufficient length to engage in and penetrate into the studs of the wall defining the opening so as to positively secure the closure in the opening. Of course, it should further be appreciated that the biasing force provided by the spring shims varies as the anchors are tightened and, accordingly, the biasing force functions for the purpose of installing/leveling/plumbing the closure in the wall opening. Still more specifically, the spring shim may, for example, be formed from galvanized spring steel sheeting or molded from resilient plastic. Hence, it should be appreciated that the spring shim may be conveniently and inexpensively produced.

Further, it should be appreciated that the spring shim may include a means for securing to the frame or jamb of the closure. Specifically, this means may take the form of at least one stablock or burr that projects from the intermediate portion and is capable of engaging into the closure where, for example, the closure is formed from wood or other relatively soft material. Alternatively or in addition, the intermediate portion of the spring shim may include at least one fastening hole adjacent to the central aperture. A screw, tack or other fastening means may be provided for fastening the spring shim to the frame or jamb of the closure through the fastening hole. As a further alternative, an appropriate adhesive may be utilized to at least temporarily secure the spring shim in the desired position on the closure frame or jamb and prevent the spring shim from being inadvertently removed from the desired position during the installation process. Finally, the spring shim could be permanently fixed to the closure frame or jamb as part of the "original equipment" manufacturing process. For example, the spring shim could be spot welded to a metal door jamb, metal window, metal transom, etc.

In accordance with yet another aspect of the present invention, a simple and convenient method is provided for installing, leveling and plumbing a closure in an opening of a wall. The method includes the initial step of attaching a series of spring shims to the closure frame or jamb at carefully selected and spaced locations. This may be accomplished by partially extending an anchor through each of a series of spaced apertures in the frame or jamb of the closure. Next is the positioning of a spring shim of a type described above on each of the anchors. Alternatively, the spring shims may be attached by a stablock, screw, adhesive, welding or any other fastening device known to those skilled in the art.

This attaching step is followed by inserting the fixture with attached spring shims into the opening of a wall. Specifically, the spring shims may be flatten slightly so that they are fully received in a gap defined between the frame or jamb of the closure and the studs of the wall framing the opening. This is then followed by the leveling and plumbing of the frame or jamb of the closure in the opening and the anchoring of the frame or jamb to the wall by engaging and penetrating the anchors into the wall. Specifically, where screw anchors are utilized, the anchors are gradually tightened so as to penetrate deep into the studs framing the wall. As they are tightened, the pressure feet of the spring shims exert an increasing biasing counter-force on the frame or jamb. Accordingly, it should be appreciated that by adjusting the various screws the relative positioning of the closure in the opening may also be adjusted and positively sustained. Thus, by utilizing a level during the adjustment of the anchors, it is possible to quickly and easily level and plumb the frame or jamb and, therefore, the closure in the opening.

As a further advantage of the present invention, it should be appreciated that the anchoring screws remain exposed so that further adjusting of the closure may be provided at anytime in the future should it become necessary for any reason. This is a significant feature as it allows compensation to be made for settling of the building structure and/or any expansion, contraction or warping of wooden components of the closure and/or studs of the wall framing the opening so that the closure may always operate smoothly as desired.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing:

FIG. 4 is a schematical side elevational view showing the relative positioning of a series of apparatus of the present invention as utilized in the method of installing a closure in a wall opening.

Reference will now be made in detail to the present preferred embodiment of the invention, an example of which is illustrated in the accompanying drawing.

DETAILED DESCRIPTION OF THE INVENTION

Figure 1:
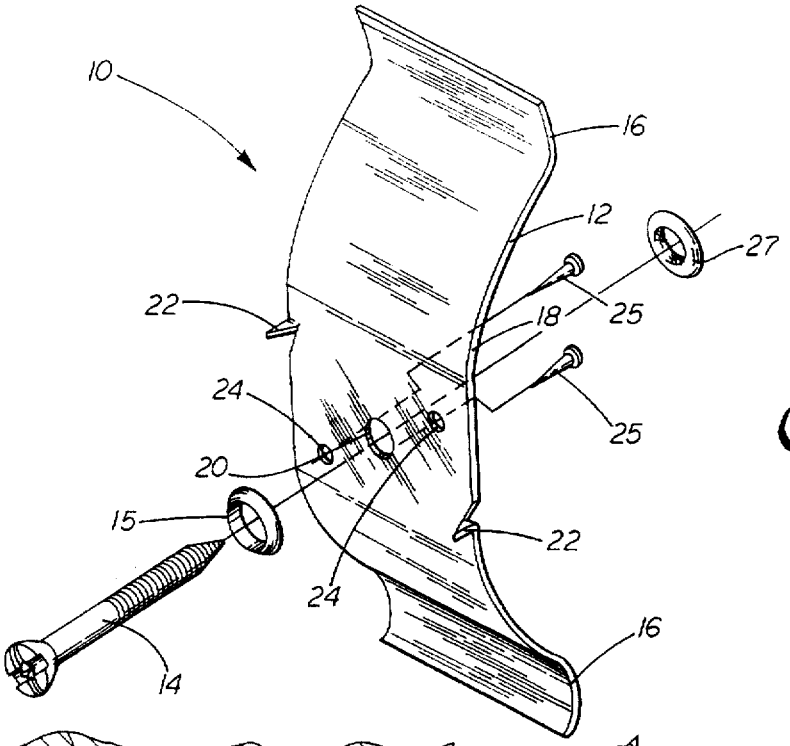
FIG. 1 is an exploded perspective view of the apparatus of the present invention for installing, leveling and plumbing a closure in a wall opening.

Reference is now made to FIG. 1 showing the apparatus 10 of the present invention for installing, leveling and plumbing a closure in an opening of a wall at the initial installation time. For purposes of this document a closure is defined as including not only a door or window, but also the associated frame or jamb and casing holding the door or window.

The apparatus 10 generally includes an elongated spring shim, generally designated by the reference numeral 12, that is formed from a sheet of resilient material, and an anchor 14 with or without a decorative washer 15 to countersink the head of the anchor. Preferably, the spring shim 12 is constructed from galvanized spring steel sheeting although it may also be molded from resilient plastic. Either construction allows the spring shim 12 to be produced relatively inexpensively while also insuring the spring shim will provide reliable and dependable performance over a long service life.

As best shown in FIG. 1, the spring shim 12 includes a pressure foot 16 at each of two ends and a an intermediated portion 18 between the pressure feet. The intermediate portion 18 also includes bowed end sections and a flat middle section. A central aperture 20 is provided in the flat middle section of the intermediate portion 18. The central aperture 20 freely receives the anchor 14. If desired, a resilient element such as an o-ring or rubber washer 27 may be utilized to secure the anchor 14 in position and thereby prevent it from falling free of the frame or jamb F and spring shim 12 during shipping and/or installation of the closure. More specifically, as shown best in FIG. 2, the o-ring 27 may be concentrically extended over the shank of the anchor 14 after the anchor is extended through the frame or jamb F and spring shim 12. The snug fit of the o-ring 27 on the anchor 14 insures that the anchor 14 does not simply drop out from the anchor head side of the frame F during handling.

Figure 2:
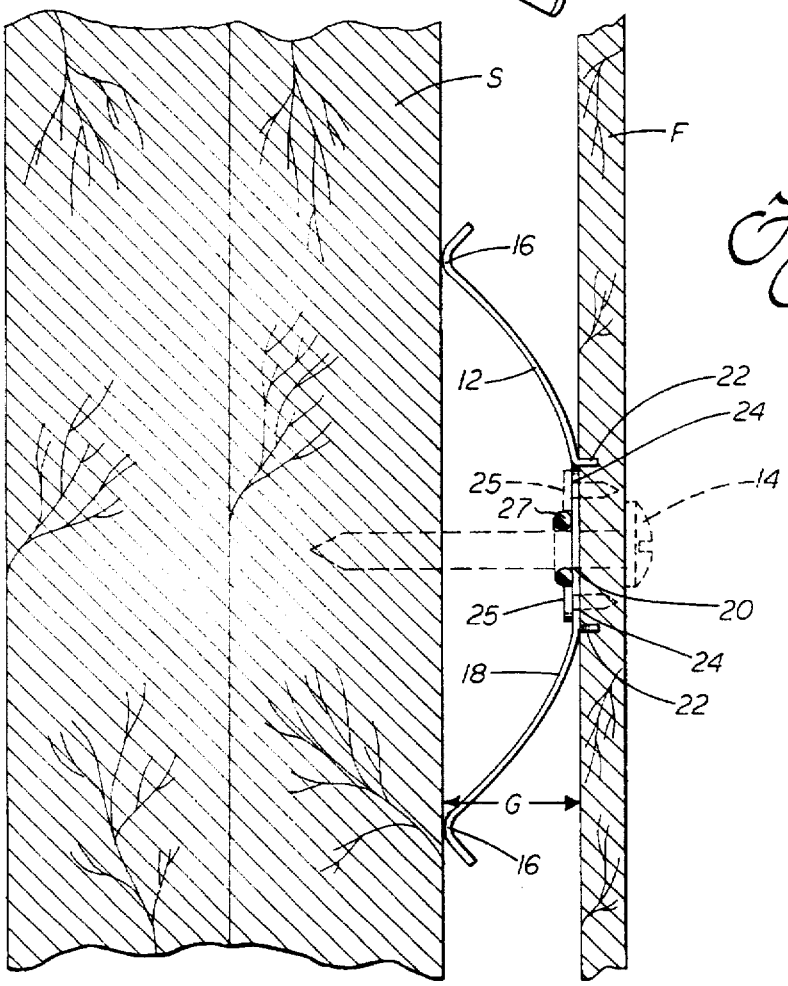
FIG. 2 shows the apparatus of FIG. 1 in a first adjusted position in the gap formed between the frame or jamb of the closure and a stud framing the same side of the wall opening.
Figure 2:
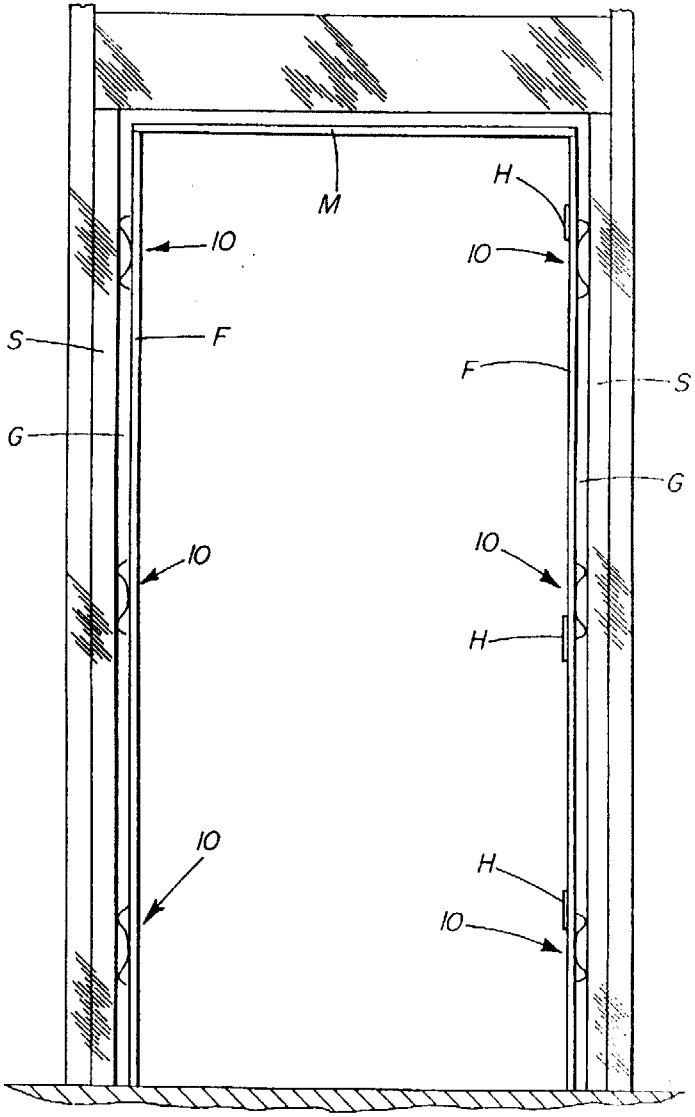
Figure 3:
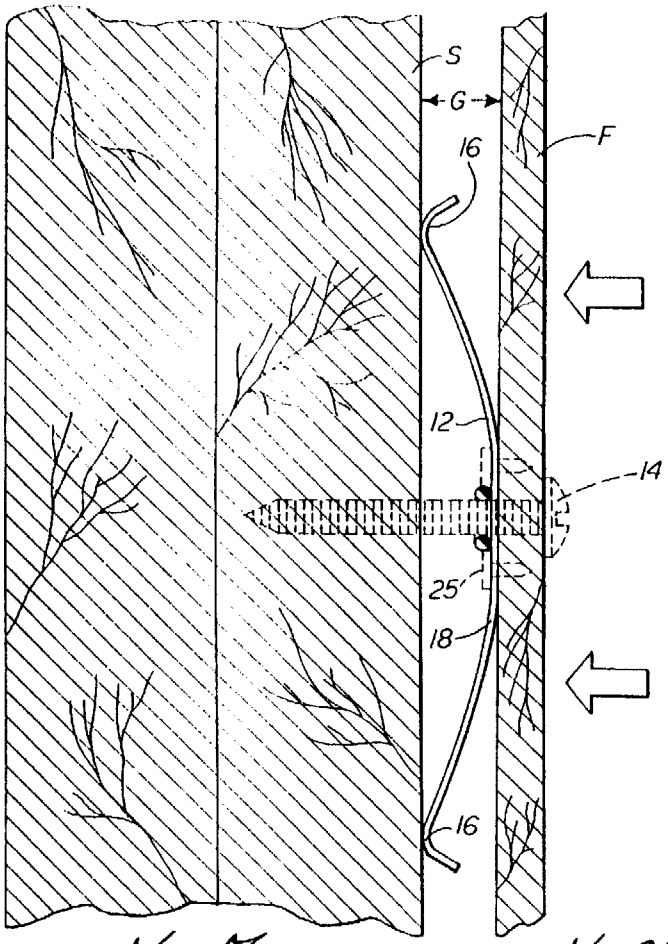
FIG. 3 is a view similar to FIG. 2 but showing the apparatus in a second adjusted position.

As best shown in FIGS. 2 and 3, anchor 14 is of a sufficient length (e.g. three inches) to extend through (1) the frame or jamb F of the closure, (2) the central aperture 20 in the intermediate portion 18 of the spring shim 12, (3) a gap G formed between the closure frame or jamb F and the stud S defining the wall opening and (4) still engage and penetrate into that stud. Accordingly, it should be appreciated that the anchor 14, which is preferably in the form of an adjustment screw, positively and securely connects the closure frame or jamb F with the stud S of the wall. This, advantageously, functions to rigidity and increase the strength of the construction beyond that possible with any prior art shim in that all fail to provide this positive interconnection of components.

Of course, it should be appreciated that while this secure and positive connection is provided, a biasing force is simultaneously being exerted by the spring shim 12 against the closure frame or jamb to positively hold the closure frame or jamb F and the closure at a selected level and plumb position within the wall opening.

The method of installing, leveling and plumbing a closure in a wall opening utilizing the apparatus 10 will now be described in detail by reference to a pre-hung door assembly. Such an assembly includes a door, a door jamb with upper cross member and integral single side casing and a separate opposing casing.

Initially the door is removed from the jamb and there is the attaching of a series of spring shims 12 at spaced positions or locations about the jamb F. In a typical installation of a door such as shown in FIG. 4, six of the apparatus 10 may be utilized; three on the hinged side of the jamb F and three on the latch side. Specifically, one apparatus 10 is provided adjacent each door hinge H and one apparatus 10 is provided on the latch side directly opposite each apparatus on the hinged side.

This may be accomplished in a number of ways including by partially extending an anchor through each of a series of spaced apertures in the jamb F. The spaced apertures may be pre-drilled holes in the jamb F or it may be necessary for the individual hanging the closure to drill those spaced apertures at the points shown. An anchor screw 14 is then positioned so as to partially extend through each of the spaced apertures in the jamb F. Specifically, the head of the anchor screw 14 is toward the inside of the jamb F and the pointed end of the screw is extended so as to project through the spaced apertures approximately one quarter to one half inch.

Next is the positioning of a spring shim 12 on each of the anchors 14. More specifically, each spring shim 12 is positioned so that the projecting portion of the anchor extends through the central aperture 20 in the intermediate portion 18. Accordingly, it should be appreciated that the flat middle section of the central portion 18 engages and rests against the jamb F. For most installations, this threading of the spring shims 12 on the anchors 14 should be sufficient to hold the spring shims in position when inserting the closure with the anchors and spring shims into the wall opening.

It should be appreciated, however, that other means may also be provided for securing the spring shims 12 in position. Such means may take any number of forms including, for example, at least one stablock 22 that projects from the intermediate portion 18 adjacent to central aperture 20 and functions to engage into the jamb F. Alternatively or in addition, the intermediate portion 18 may include at least one fastening hole 24 adjacent to central aperture 20 and means such as a screw or tack fastener 25 to fasten the spring shim 12 to the jamb F through the fastening hole 24.

As a further alternative, the face of the intermediate portion 18 engaging the jamb F may include an adhesive to secure the spring shim 12 in position. Of course, anyone or all of these measures may be included and utilized where the jamb F is constructed from a relatively soft material such as wood. However, where the jamb F is constructed from, for example, metal, fiberglass or plastic, the stablocks 22 would be an ineffective securing means. In such a situation one or more sheet metal screws, an adhesive or a spot weld are just three possible alternative means of attachment that could be used. If, stablocks 22 are present, however, the stablocks are designed to be simply broken off or bent out of the way to provide the necessary clearance when securing the spring shim 12 in position by other means as described.

In any event, with the spring shims 12 properly positioned on the jamb F, the next step of the method involves inserting the jamb F with the attached spring shims into the wall opening. Specifically, the wall opening, is defined by the studs S so as to be approximately 2 inches wider and 1 to 2 inches taller than the jamb F. Accordingly, it is possible to complete the insertion so that the spring shims 12 (and anchors 14, if present) are received in the resulting gap G defined between the jamb F and studs S at each side of the opening. Of course, it should be appreciated that it may be necessary to slightly flatten the spring shims 12 to provide the necessary clearance to allow insertion. When fully inserted, the side of the casing integral with the jamb F should be flat against the wall.

Once the jamb F is inserted in the opening, the next step involves the leveling and plumbing of the jamb F in the opening and the simultaneous positive anchoring of the jamb to the wall by engaging and penetrating the anchors 14 into the studs S defining the opening. More specifically, the anchoring screws 14 extending outwardly through the jamb F are gradually tightened until they engage and penetrate into the studs S. As this is done, it should be appreciated that an increasing counter-biasing force is exerted on the jamb F by the spring shim 12 associated with each of the anchors 14. Thus, the jamb F is positively held in position during the operation of tightening the anchors 14. Of course, throughout the anchor tightening process, a level is utilized on the jamb F to insure that the jamb is level and plumb in the wall opening.

Specifically, initially it is necessary to confirm horizontal level. Prior to engaging any of the anchors with the wall studs, a level is placed along the upper cross-member M of the closure frame or jamb F and the cross-member is brought to a level position (e.g. by placing shims under the jamb connected to the low side or end of the cross-member) and then the top anchor 14 on the hinge side of the closure is tightened so as to penetrate into the wood stud S and secure the closure frame in horizontal level.

Now again confirming that the integral door casing is flat against the wall, the other two anchors 14 on the hinge side of the closure are tightened so as to engage and penetrate into the wall stud. A six foot door level may be utilized to insure that vertical plumb is achieved from the top to the bottom of the hinge side of the jamb F. Any necessary adjustments are made by loosening or tightening the hinge side anchors 14. The same procedure is then followed on the latch side with anchors 14 being gradually tightened to engage and penetrate into the wall stud S on the latch side of the jamb F. Again, it is convenient to work from top to bottom loosening and tightening the anchors 14 while consulting the 6 foot door level to insure that plumb is achieved on the latch side of the jamb F.

Once completed, the other half of the door casing (not shown) is installed and the door is then mounted on its hinges H on the frame or jamb F. Of course, the installation and leveling of a door has been presented for purposes of illustration and description. The invention is not to be considered as limited thereto and, in fact, may be used in a similar manner to install a window, transom, portal, gable air vent, sidelight, view port, etc. of substantially any shape in a wall opening. Of course, the number of apparatus 10 utilized for purposes of installation may vary depending upon the relative size and shape of the closure. For example, smaller windows may only require four apparatus 10, two on each side, whereas larger windows may require 6 apparatus in the manner of the installation of the door just described.

Advantageously, it should be appreciated that utilization of the apparatus 10 of the present invention to level and plumb a closure eliminates the need to laterally adjust the vertical orientation of the closure by placing shims at various locations in the gap between the jamb and the wall studs S outlining the opening of a door as commonly practiced by today's carpenters. Thus, the resulting mess characterized by the use of wood shims including wood splinters, broken shims and inadvertent hammering impressions left in the door jamb when attempting to drive a shim in position are avoided.

Additionally, it should be appreciated that the apparatus 10 provides an almost infinite range of vertical adjustment as necessary to provide accurate and proper balance to the closure as well as the best possible appearance. Further, it should also be appreciated that the apparatus 10 provides for horizontal level by simply securing a single anchor 14 in position. As a result of these features, the time factor necessary to install a closure is decreased for a typical pre-hung wood door by, for example, 75% in most cases. Further, most doors may now be installed relatively easily by a single person.

Of course, some installation jobs are more difficult than others. In rare cases, and primarily due to warpage, the latch side of a door jamb may be level but the door may not latch as well as it should and/or the space around the latch side is not even when the door is closed. One of the additional advantages of the present invention over the standard shim method of hanging doors is that you can adjust the space for appearance sake by simply screwing the adjusting screws 14 of the latch side of the door in or out to meet personal preference. Thus, it should be appreciated that it is now possible to "fine tune" the closure via adjustment of the anchoring screws 14 in a way that has never before been possible. Further, while the anchors 14 may be recessed in the jamb for best appearance, it should be appreciated that they remain readily accessible throughout the life of the installation. Accordingly, should the structure settle and the door become misaligned over time, adjustments may be made to compensate for the settling. This is accomplished by simply adjusting the anchors 14 with a screwdriver, at the extreme ease and convenience of the individual.

For example, in a worst case scenario when a door loses its horizontal level from structural shifting and settling, it is possible to completely re-establish horizontal level by simply loosening the anchor 14 on the side needing adjustment and moving the jamb F to the new horizontal level position and reanchoring the jamb. This ability to make such convenient adjustment has never been provided for in the prior art.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, the apparatus 10 may be mounted on the door or window jamb at the time of production of the pre-hung door or window assembly. Further, while the spring shims 12 are shown with the pressure feet in engagement with the studs S defining the sides of the wall opening, they could be reversed with their feet in engagement with the jamb F.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. A prefabricated closure assembly, comprising:

a closure;

a frame for said closure including a jamb;

means attached to said jamb for securing said closure assembly in a wall opening said securing means including (1) a series of spring shims formed from resilient material including a pair of pressure feet for engaging the wall and an intermediate portion between said pressure feet including a central aperture and at least one fastening hole for securing said spring shim to said closure adjacent said central aperture; (2) a fastener for securing said spring shim to said closure through said fastening hole; and (3) a series of anchors, said anchors extending through said jamb and engaging and penetrating into the wall so as to anchor the closure assembly in the wall opening; said series of spring shims and cooperating anchors being provided at spaced locations around said jamb whereby said spring shims provide biasing force for leveling and plumbing said closure assembly in the wall opening and said anchors provide secure positive engagement.

2. The assembly of claim 1, further including means for positively holding said series of anchors in said series of spring shims and said frame.

3. The assembly of claim 2, wherein said holding means is a series of resilient washers, one washer being concentrically received over each of said anchors.

* * * * *